US010377034B2

(12) United States Patent
Grinwald et al.

(10) Patent No.: US 10,377,034 B2
(45) Date of Patent: Aug. 13, 2019

(54) TOOL REPAIR PACKAGE AND REPLACEMENT SYSTEM

(71) Applicant: Snap-on Incorporated, Kenosha, WI (US)

(72) Inventors: Brent J. Grinwald, Appleton, WI (US); Frank J. Beno, Menasha, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 16/171,686

(22) Filed: Oct. 26, 2018

(65) Prior Publication Data

US 2019/0061140 A1 Feb. 28, 2019

Related U.S. Application Data

(63) Continuation of application No. 15/277,627, filed on Sep. 27, 2016, now Pat. No. 10,160,113, which is a continuation of application No. 14/488,928, filed on Sep. 17, 2014, now Pat. No. 9,475,187.

(60) Provisional application No. 61/889,602, filed on Oct. 11, 2013.

(51) Int. Cl.

| | |
|---|---|
| ***B25H 3/06*** | (2006.01) |
| ***B25H 3/00*** | (2006.01) |
| ***B65D 75/32*** | (2006.01) |

(52) U.S. Cl.

CPC ..... *B25H 3/06* (2013.01); *B25H 3/006* (2013.01); *B65D 75/321* (2013.01)

(58) Field of Classification Search

CPC ..... B25H 3/06; B25H 3/006; B65D 75/321
USPC ..... 206/461–471, 349–383, 207
See application file for complete search history.

(56) References Cited

U.S. PATENT DOCUMENTS

| | | | | |
|---|---|---|---|---|
| 2,775,341 A | | 12/1956 | Williams | |
| 3,393,587 A | | 7/1968 | Jolliff | |
| 3,759,375 A | * | 9/1973 | Nappi | A45D 40/0087 132/286 |

(Continued)

FOREIGN PATENT DOCUMENTS

| | | |
|---|---|---|
| CA | 2283552 | 10/2001 |
| CN | 201494779 | 2/2010 |

(Continued)

OTHER PUBLICATIONS

Canadian Examiner's Report for Application No. 2,864,557 dated Dec. 6, 2016, 3 pages.

(Continued)

*Primary Examiner* — Chun Hoi Cheung
(74) *Attorney, Agent, or Firm* — Seyfarth Shaw LLP

(57) ABSTRACT

A tool repair system that aids in the repair of malfunctioned inner tool components. The system includes a package having a fully assembled component disposed on top of a component locating structure and held in place by one or more retainers. After removing the malfunctioned component, the tool can be lowered onto the component locating structure, thereby pushing the retainers off the fully assembled component and coupling the fully assembled component to the tool via an opening in the tool. Repairing the tool is therefore quick, easy, and does not require extensive knowledge of the inner workings of the tool.

16 Claims, 6 Drawing Sheets

(56) References Cited

U.S. PATENT DOCUMENTS 3,870,144 A * 3/1975 Hanson ..... B65D 73/00 206/349
4,147,076 A 4/1979 Wright
4,216,860 A * 8/1980 Heimann ..... A61M 25/002 206/364
4,261,233 A 4/1981 Konecny
4,302,990 A 12/1981 Chrichton
4,307,632 A 12/1981 Penner
4,375,259 A 3/1983 Mancini
4,742,909 A 5/1988 Apprille, Jr. et al.
4,750,619 A * 6/1988 Cohen ..... A61F 2/0095 206/363
4,762,033 A 8/1988 Chow
5,082,112 A * 1/1992 Dunklee ..... A61B 1/00142 206/363
5,176,258 A * 1/1993 Antal ..... B65D 75/326 206/438
5,485,917 A * 1/1996 Early ..... B65D 5/725 206/363
5,690,222 A * 11/1997 Peters ..... B65D 75/32 206/339
5,803,253 A * 9/1998 Zakarian ..... B65D 73/0064 206/349
5,875,532 A 3/1999 Musgrave
5,916,339 A 6/1999 Dumont
5,947,284 A * 9/1999 Foster ..... A61B 50/33 206/364
6,009,777 A 1/2000 Jarvix
6,719,154 B2 4/2004 Kao
6,883,767 B1 4/2005 Huang
7,143,669 B2 12/2006 Hu
7,765,897 B2 8/2010 Kim et al.
7,837,033 B2 * 11/2010 Schein ..... B25H 3/00 206/350
8,240,468 B2 * 8/2012 Wilkinson ..... A61B 5/417 206/363
8,939,285 B2 * 1/2015 Trontel ..... B65D 73/0064 206/335
2006/0076259 A1 4/2006 Browder
2008/0083304 A1 4/2008 Finn
2011/0203092 A1 8/2011 Cullen
2011/0226645 A1 9/2011 Kierce
2012/0272793 A1 11/2012 Lin

FOREIGN PATENT DOCUMENTS

JP 2004033490 5/2004
WO 2012134469 10/2012

OTHER PUBLICATIONS

UK Combined Search and Examination Report for Application No. GB1601440.9 dated Feb. 26, 2016, 6 pages.
Canadian Examiner's Report for Application No. 2,864,557 dated Dec. 21, 2016, 3 pages.
Taiwan Search Report for Application No. 103134078 dated Dec. 18, 2015, 7 pages.
UK Combined Search and Examination Report for Application No. GB1418084.8 dated Jan. 23, 2015, 7 pages.
AU Patent Examination No. 1 for Application No. 2014240294 dated Oct. 8, 2015, 5 pages.

* cited by examiner

TOOL REPAIR PACKAGE AND REPLACEMENT SYSTEM

CROSS REFERENCES TO RELATED APPLICATIONS

This application claims the benefit of U.S. patent application Ser. No. 15/277,627, filed Sep. 27, 2016, titled Tool Repair Package and Replacement System; which claims the benefit of U.S. patent application Ser. No. 14/488,928, filed Sep. 17, 2014, titled Tool Repair Package and Replacement System; which claims the benefit of U.S. Provisional Patent Application Ser. No. 61/889,602, filed Oct. 11, 2013, titled Tool Repair Package and Replacement System, each of the contents of which are incorporated herein by reference in their entirety.

TECHNICAL FIELD

The present application relates to a repair system for a tool. More particularly, the present application relates to a tool repair system that replaces a dysfunctional part with a pre-assembled mechanism.

BACKGROUND

Tools, such as ratchets, sometimes malfunction and need to be repaired to replace a broken part. The tool can be sent to a manufacturer or outside repair center to fix the malfunctioning part. However, doing so requires time and delays any work being done with the tool. Accordingly, systems exist to repair tools in the field for quicker repair as compared to sending the tool to an offsite repair facility.

Repairing a tool in the field requires the user to have extensive knowledge of the tool and the inner workings thereof. For example, in repairing a ratchet wrench, many repair systems require the larger components of the ratchet wrench to be inserted into the ratchet head body and additional small components be placed around the larger components. This assembly can be complicated and time consuming to a user who lacks extensive knowledge regarding the inner workings of the tool. Additionally, the small parts of the ratchet tool can be lost by the user, regardless of the expertise in repairing the tool or knowledge of the inner workings of the tool.

Some prior art systems assemble several components of the tool into a "sub-assembly" for easier repair of the tool. If any component of the sub-assembly malfunctions, a new sub-assembly can be inserted into the tool to speed up repair time. However, even with the sub-assembly system, small parts must be placed around the sub-assembly, and can be lost or difficult to assemble for a user who lacks extensive knowledge of the tool.

SUMMARY

The present application discloses a tool repair package and system that allows for faster repair of malfunctioned components without requiring extensive knowledge of the inner workings of the tool and replacement of small tool pieces. The tool system includes a package having a fully assembled component inside, where the fully assembled component is located on a component locating structure and held in place by one or more retainers. The tool can then be placed over the component locating structure, pushing the retainers off the fully assembled component, and coupling the fully assembled component to the tool by way of a friction fit, snap fit, or other mechanism. Replacing inner tool parts is therefore quick and simple, avoiding the need for extensive expertise with the inner workings of the tool and preventing small tool parts from being lost.

In an embodiment, a tool component carrier apparatus is disclosed. The tool component carrier apparatus includes a packaging tray and a component locating structure formed in the packaging tray. The component locating structure is adapted to locate a plurality of assembled replacement components of a tool in a collectively installable configuration. A packaging cover is adapted to mate with the packaging tray to define a package. The package is adapted to enclose the plurality of assembled replacement components and retain the plurality of assembled replacement components on the component locating structure in the collectively installable configuration.

In another embodiment, a tool repair system is disclosed. The tool repair system includes a plurality of assembled replacement components of a tool and a packaging tray including a component locating structure formed in the packaging tray. The component locating structure is adapted to locate the plurality of assembled replacement components of the tool in a collectively installable configuration. A packaging cover is adapted to mate with the packaging tray to define a package and includes an embossed portion defining a component enclosure. The embossed portion is adapted to align with the component locating structure to retain the plurality of assembled replacement components on the component locating structure in the collectively installable configuration. One or more removable retainers are disposed around the plurality of assembled replacement components to retain the plurality of assembled replacement components in the collectively installable configuration when the packaging cover is separate from the packaging tray. The removable retainers are adapted to be stripped from the plurality of assembled replacement components by an interference with a portion of the tool while the plurality of replacement components are pushed into the tool by the component locating structure.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
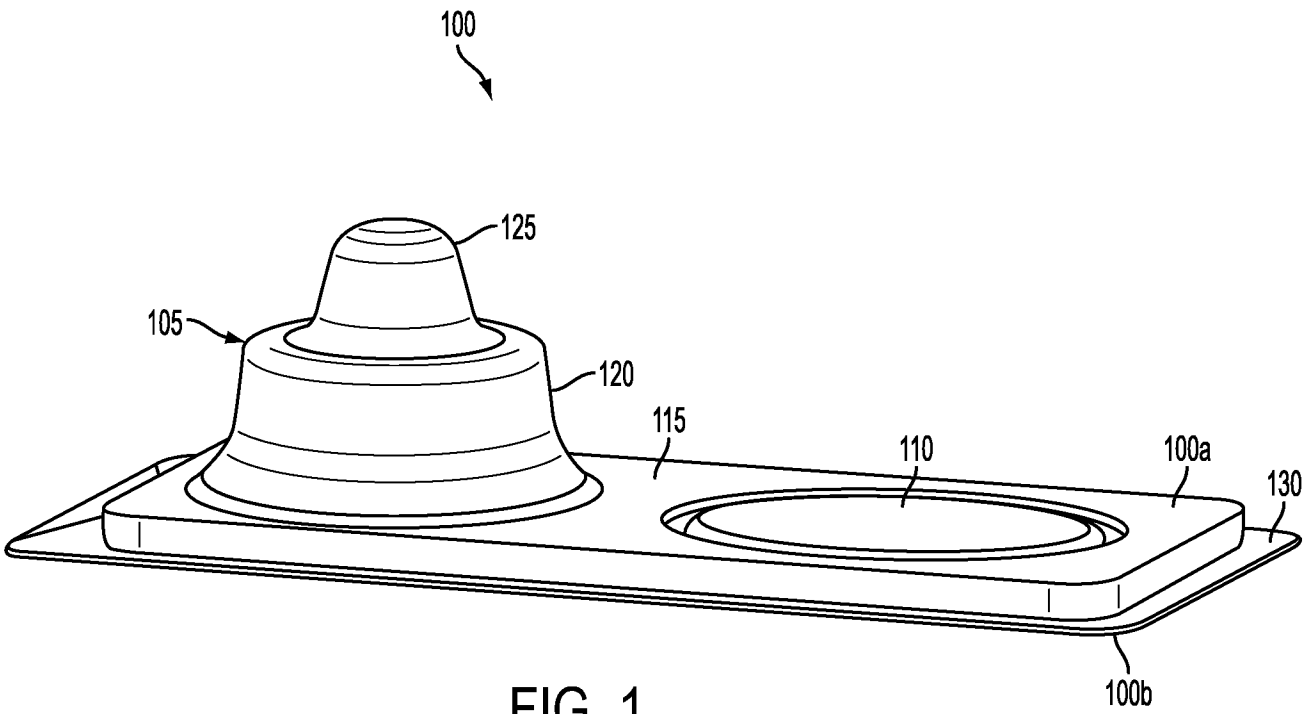
FIG. 1 is a perspective view of a package according to an embodiment of the present application.

While this application is susceptible of embodiments in many different forms, there is shown in the drawings, and herein described in detail, certain embodiments with the understanding that the present disclosure is to be considered as an exemplification of the principles of the application and are not intended to limit the broad aspect of the application to the embodiments illustrated.

The present application discloses a tool repair system that aids in the repair of malfunctioned inner tool components. The system includes a package having a fully assembled component disposed on a component locating structure and held in place by one or more retainers. After removing the malfunctioned component, the tool can be lowered onto the assembled components, thereby pushing the retainers off the fully assembled component and coupling the fully assembled component to the tool via an opening in the tool. Repairing the tool is therefore quick, easy, and does not require extensive knowledge of the inner workings of the tool.

Figure 2:
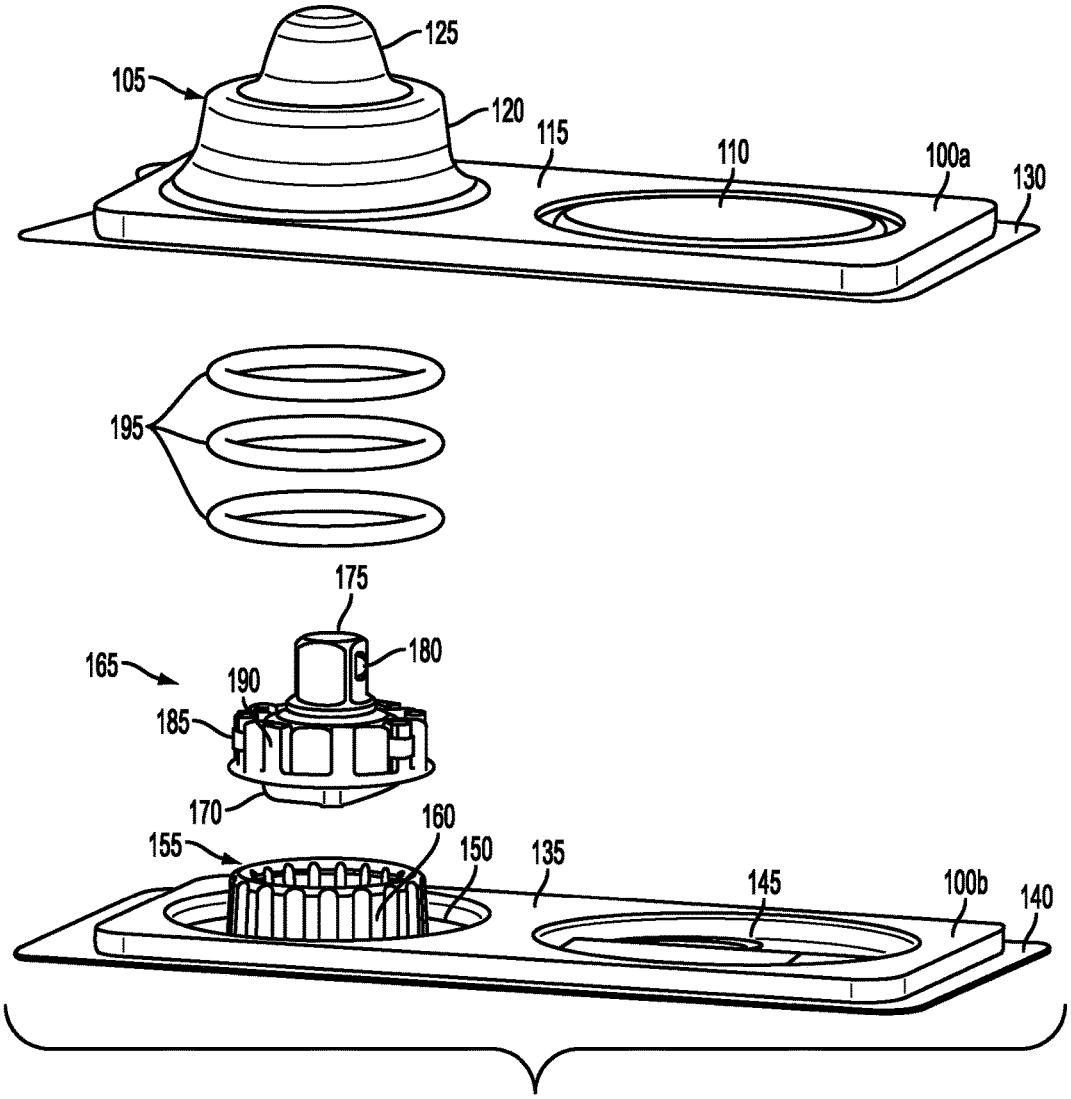
FIG. 2 is an exploded view of a package according to an embodiment of the present application.

As shown, FIGS. 1 and 2 illustrate an assembled package 100 according to an embodiment of the present application. The assembled package 100, illustrated in FIG. 1, includes a top package portion or packaging cover 100*a* and a bottom package portion or packaging tray 100*b* coupled together using any known means, for example, by way of a friction fit, snap fit, or other mechanism. The packaging cover 100*a* and packaging tray 100*b* may each be single monolithically formed pieces.

The packaging cover 100*a* includes an embossed portion defining a component enclosure, such as, a dome 105, on a first section and a cover 110 on a second section of the packaging cover 100*a* away from the first section. The dome 105 and cover 110 are disposed on a top base 115 that acts as the structural backbone of the packaging cover 100*a*. The dome 105 includes a frustroconical section 120 and a tip 125 extending from the frustroconical section 120. The packaging cover 100*a* can also include a top perimeter 130 that matingly engages with the packaging tray 100*b*.

The packaging tray 100*b* can include a bottom base 135 adapted to matingly couple with the top base 115 and a bottom perimeter 140 adapted to matingly couple with the top perimeter 130. The packaging tray 100*b* can include a component storage compartment or receptacle 145 that aligns with the cover 110, and a recess 150 that aligns with the dome 105 when the packaging cover 100*a* and the packaging tray 100*b* are coupled together. Each of the receptacle 145 and the recess 150 are indented within the bottom base 135. The receptacle 145 can hold small objects that are used during the repair process and the recess 150 can surround a component locating structure 155, which is also aligned with the dome 105.

The component locating structure 155 is adapted to locate a plurality of assembled replacement components of a tool in a collectively installable configuration. The component locating structure 155 can include one or more columns 160 adapted to matingly engage with an assembled component 165. For example, the assembled component 165 can include a ratchet mechanism 170, together with a drive portion 175 and detent mechanism 180 for removably securing, for example, a socket. The assembled component 165 can also include a cap 185 with grooves 190 that matingly engage with the columns 160. The cap 185 can therefore slide over the component locating structure 155 and the grooves 190 can engage the columns 160 to maintain the cap 185 in place and hold the assembled component 165 on the component locating structure 155. In addition, one or more retainers 195 can maintain the assembled component 165 together and on the component locating structure 155. The retainers 195 can be O-rings, as shown, or can be any other structure that is capable of holding the assembled component 165 together, and that can be removed or stripped from the assembled component 165 when the assembled component 165 is coupled to a tool.

The assembled component 165 may be disposed on and supported by the component locating structure 155 in the assembled package 100. In this respect, the assembled component 165 extends into and is enclosed in the package 100 by the dome 105. The retainers 195 can be disposed on and maintain the assembled component 165 on the component locating structure 155 or the retainers 195 can be disposed in the receptacle 145 in the assembled package 100.

Figure 3:
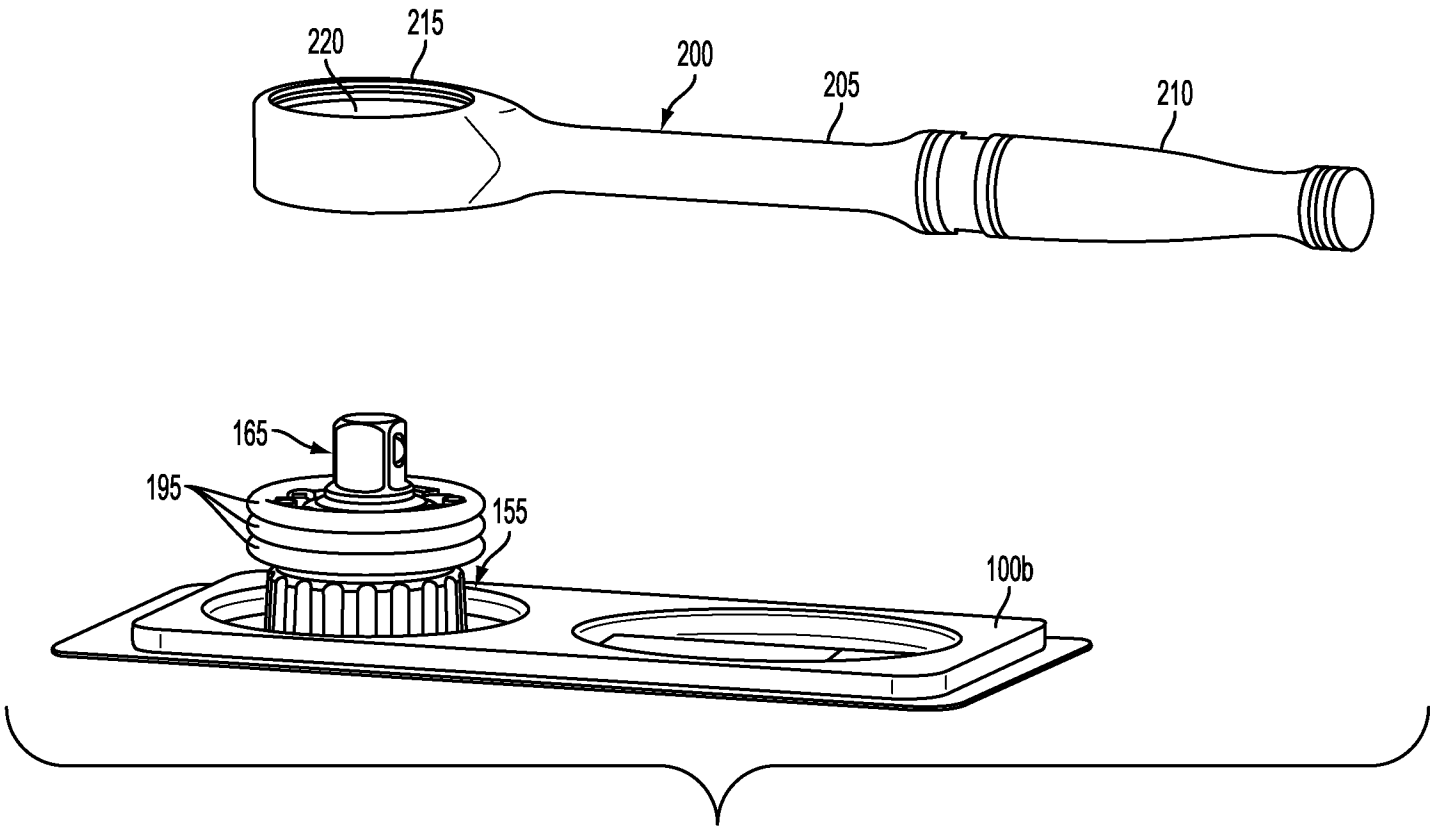
FIG. 3 is a perspective view of a bottom packaging portion of the package next to a tool, according to an embodiment of the present application.
Figure 4:
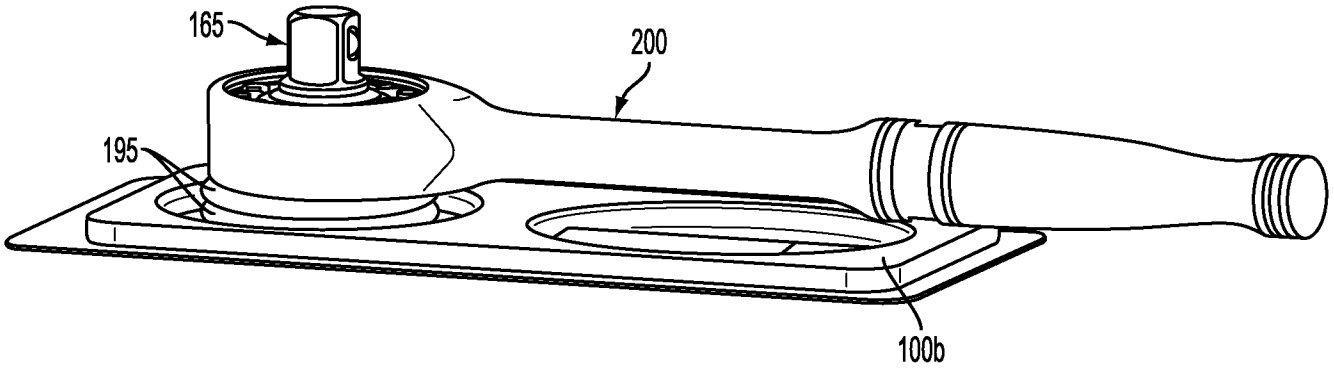
FIG. 4 is a perspective view of the tool engaging the fully assembled component according to an embodiment of the present application.
Figure 5:
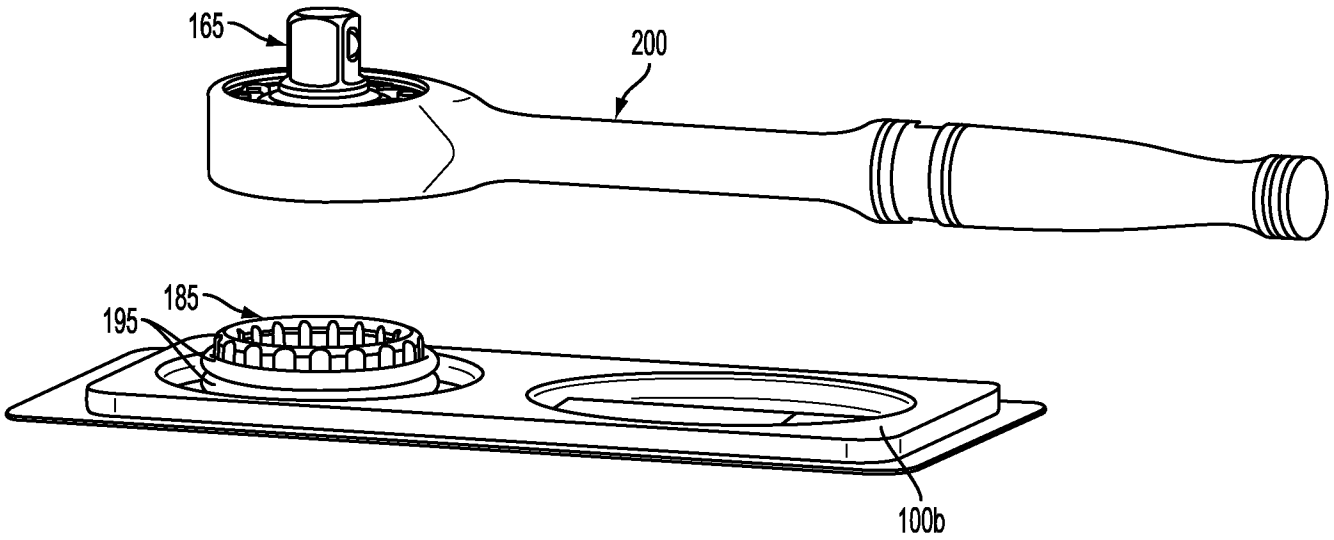
FIG. 5 is a perspective view of the tool and fully assembled component being removed from the bottom packaging portion of the package according to an embodiment of the present application.

FIGS. 3-5 illustrate an exemplary tool that can be used to effect the repair method of the present application. As shown, the tool 200 includes a neck 205 connecting a grip 210 to a ratchet head 215. The ratchet head 215 includes an opening 220 to receive the assembled component 165 via a friction fit, snap fit, or other known means (for example, using one or more fasteners, retaining rings, or other mechanisms). Although the tool 200 is shown as a ratchet in FIGS. 3-5, any tool can be implemented without departing from the spirit and scope of the present application.

Figure 6:
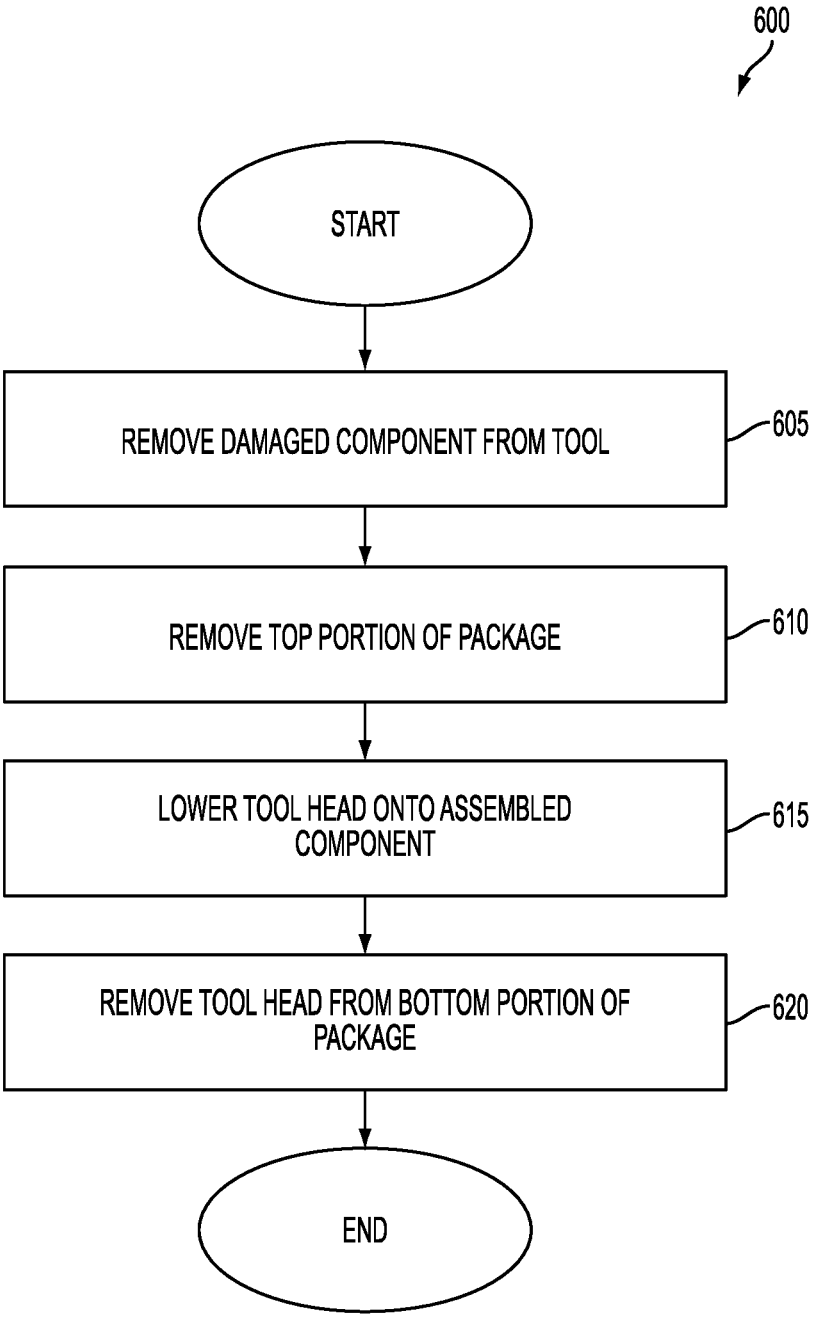
FIG. 6 is a flow chart illustrating the process of replacing a tool part according to an embodiment of the present application.

FIG. 6 illustrates a flow chart depicting a method 600 according to the present application, and FIGS. 3-5 illustrate the tool 200 implementing this method. As shown in FIG. 6, the method 600 begins in step 605, where the damaged component is removed from the tool 200. The method 600 then proceeds to step 610 where the packaging cover 400*a* of the package 100 is removed, exposing the assembled component 165, as shown in FIG. 3. The tool 100 is then lowered onto the assembled component 165, as shown in FIG. 4, in step 615. This step causes an interface of the tool to push the retainers 195 downward, and couple the assembled component 165 into the opening 220 of the tool 200. The assembled component 165 therefore mates with the opening 220 and is maintained within the opening 220 by, for example, a frictional engagement or a snap fit.

As shown in FIG. 5, the tool head 215 can then be removed from the packaging tray of the package 100, thereby repairing the malfunctioned component of the tool. In the above process, the internal components of the tool 100 are fully assembled into the package 100 as the assembled component 165, rather than requiring the user to insert a sub-assembly and other small parts around the sub-assembly. The user can therefore repair the tool 200 in the field without substantial knowledge of the inner workings of the tool 200 and without losing any small parts that may surround the sub-assembly.

The above process and structure is described as being a package that includes components to be used in repairing a tool. However, the disclosed aspects can also be implemented when manufacturing the tool in the first instance, where of course there would be no need for a fully-enclosed package housing the fully assembled components. Rather, during manufacturing, the tool 200 could simply be lowered onto the fully assembled component 165 in the same manner, but without a covered package and without the need to remove malfunctioned components from the tool prior to assembly.

The term "coupling" is used herein to describe a connection between two components. The term "coupling" is not intended to be limited to a direct physical connection, but can include any indirect or direct physical, electrical, electromagnetic, or other such connection.

The present application describes certain methods occurring in a particular order. However, this order is exemplary, and the processes of the present application need not be performed in the stated order. In addition, any one or more steps of the disclosed processes can be omitted without departing from the spirit and scope of the present application.

The matter set forth in the foregoing description and accompanying drawings is offered by way of illustration only and not as a limitation. While certain embodiments are shown and described, it should be apparent to those skilled in the art that changes and modifications may be made without departing from the broader aspects of the application. The actual scope of the protection sought is intended to be defined in the claims of the application when viewed in their proper perspective based on the prior art.

What is claimed is:

1. A tool component comprising:

a packaging tray;

a replacement component of a tool disposed within the packaging tray;

a component locating structure formed in the packaging tray and receiving the replacement component; and a retainer elastically coupled to the replacement component and elastically retaining the replacement component on the component locating structure, wherein installation of the replacement component on the tool causes the retainer to be removed from the replacement component, and to be disposed on the component locating structure.

2. The tool component carrier of claim 1, further comprising a packaging cover that mates with the packaging tray to define a package, the package encloses the replacement component and retains the replacement component on the component locating structure in an installable configuration.

3. The tool component carrier of claim 2, wherein the packaging cover includes an embossed portion that defines a component enclosure, the embossed portion is aligned with the component locating structure to retain the replacement component on the component locating structure in the installable configuration.

4. The tool component carrier of claim 3, wherein the embossed portion is a dome shape and includes a frustroconical section and a tip extending therefrom.

5. The tool component carrier of claim 1, wherein the retainer is stripped from the replacement component by an interference with a portion of the tool while the replacement component is pushed into the tool.

6. The tool component carrier of claim 2, further comprising a component storage compartment formed in the package tray separate from the component locating structure.

7. The tool component carrier of claim 6, further comprising a storage compartment cover formed in the packaging cover and aligning with the component storage compartment.

8. The tool component carrier of claim 7, further comprising a recess formed in the packaging tray and surrounding the component locating structure.

9. A tool component carrier comprising:

a packaging tray;

a replacement component of a tool disposed within the packaging tray;

a component locating structure formed in the packaging tray and locating the replacement component in an installable configuration separate from the tool; and a retainer elastically coupled to the replacement component and elastically retaining the replacement component on the component locating structure in the installable configuration, wherein installation of the replacement component on the tool causes the retainer to be removed from the replacement component, and to be disposed on the component locating structure.

10. The tool component carrier of claim 9, further comprising a packaging cover that mates with the packaging tray to define a package, the package encloses the replacement component and retains the replacement component on the component locating structure in the installable configuration.

11. The tool component carrier of claim 10, wherein the packaging cover includes an embossed portion that defines a component enclosure, the embossed portion is aligned with the component locating structure to retain the replacement component on the component locating structure in the installable configuration.

12. The tool component carrier of claim 11, wherein the embossed portion is a dome shape and includes a frustroconical section and a tip extending therefrom.

13. The tool component carrier of claim 9, wherein the retainer is stripped from the replacement component by an interference with a portion of the tool while the replacement component is pushed into the tool.

14. The tool component carrier of claim 10, further comprising a component storage compartment formed in the package tray separate from the component locating structure.

15. The tool component carrier of claim 14, further comprising a storage compartment cover formed in the packaging cover and aligning with the component storage compartment.

16. The tool component carrier of claim 15, further comprising a recess formed in the packaging tray and surrounding the component locating structure.

* * * * *